US005291164A

United States Patent [19]

Levisse

[11] Patent Number: 5,291,164

[45] Date of Patent: Mar. 1, 1994

[54] RADIATING HIGH FREQUENCY LINE

[75] Inventor: André Levisse, Paris, France

[73] Assignee: Societe Anonyme Dite Alcatel Cable, Clichy Cedex, France

[21] Appl. No.: 992,739

[22] Filed: Dec. 18, 1992

[30] Foreign Application Priority Data

Dec. 19, 1991 [FR] France ..... 91 15803

[51] Int. Cl.[5] ..... H01Q 13/22

[52] U.S. Cl. ..... 333/237; 343/770

[58] Field of Search ..... 333/237; 343/770, 771

[56] References Cited

U.S. PATENT DOCUMENTS

| | | | |
|---|---|---|---|
| 3,729,740 | 4/1973 | Nakahara et al. | 333/237 X |
| 3,795,915 | 3/1974 | Yoshida | 343/771 |
| 4,625,187 | 11/1986 | Bocher | 333/237 |

FOREIGN PATENT DOCUMENTS

| | | | |
|---|---|---|---|
| 116055 | 10/1978 | Japan | 333/237 |
| 99803 | 7/1980 | Japan | 333/237 |
| 1481485 | 7/1977 | United Kingdom . | |

*Primary Examiner*—Paul Gensler
*Attorney, Agent, or Firm*—Sughrue, Mion, Zinn, Macpeak & Seas

[57] ABSTRACT

The present invention concerns a high frequency radiating line for radiating electromagnetic energy in a frequency band and comprising at least one tubular conductor (23) surrounding a longitudinal axis (X) and having a plurality of apertures formed into a series of identical patterns (M1) repeated periodically with a period P along said line, characterized in that, when the operating frequency band is of the type $[f_r,(N+1)f_r]$, where $f_r$ is a given frequency and N is a positive integer greater than 1, each of said patterns (M1) comprises N apertures 0 to N-1 and satisfying the following equations:

$$z_k = \frac{P \cdot p_k}{N+2}$$

$$a_k = \frac{\sin\left(\frac{(p'-p_k)\pi}{N+2}\right)\sin\left(\frac{(p''-p_k)\pi}{N+2}\right)}{\sin\left(\frac{p'\pi}{N+2}\right)\sin\left(\frac{p''\pi}{N+2}\right)} a_o$$

where:

the index k is an integer such that $1 \leqq k \leqq N-1$ and refers to the k'th aperture of one of said patterns (M1), $z_k$ is the distance between said k'th aperture and first aperture (F0) of the pattern, $a_k$ is the polariability of the k'th aperture, $a_o$ is the polarizability of the first aperture, $$-p' = E\left(\frac{N+2}{4}\right) \text{ or } p' = E\left(\frac{N+2}{4}\right) + 1$$

$$-p'' = E\left(\frac{3(N+2)}{4}\right) \text{ or } p'' = E\left(\frac{3(N+2)}{4}\right) + 1$$

where E(x) designates the integer part of x, $p_k$ is an integer such that $1 \leqq p_k \leqq N+1$, said integers $p_k$ being pairwise distinct, such that $p_k < p_{k+1}$, and different from p' and p''.

10 Claims, 7 Drawing Sheets

RADIATING HIGH FREQUENCY LINE

The present invention concerns a radiating high frequency line. A radiating high frequency line refers to a line formed by a cable or a waveguide capable of radiating to the outside a portion of the electromagnetic energy which it transmits. The interest here is more particularly in radiating cables.

Radiating cables are adapted to be used as transmission means for high frequency signals between a transmitter and a receiver under conditions in which signals radiated from a point source are attenuated rapidly.

They are generally formed from a coaxial cable comprising a conductive core surrounded by an intermediate insulating sheath of a dielectric material for example, an outer conductor provided with regularly spaced apertures or slots for the passage of electromagnetic radiation and a protective outer insulating jacket. By virtue of the apertures formed in the outer conductor, a portion of the power flowing in the cable and transmitted from a transmitting source is coupled to the exterior. The cable thus acts as an antenna and the power coupled to the exterior is called the radiated power.

One of the properties required of a radiating cable is to ensure at least a minimum radiated power at a given distance from the longitudinal axis, specified by the user.

When the slots are repeated periodically, with a suitable period, they are in phase, which makes it possible to achieve good stability of the radiated power at a large distance from the cable, over a frequency band called the principal radiating mode band and bounded by two frequencies called $f_{start}$ and $f_{end}$. This stability makes it possible to satisfy minimum power requirements for the use of the cable in a reliable manner. Thus, if the stability is not guaranteed, major variations in the radiated power as a function of the point of reception along the length of the cable are such that it is difficult to ensure a minimum power value at a given distance from the cable. These variations moreover require the use of receivers which have a large dynamic range and which are accordingly costly.

When the operating frequency of the cable is lower than $f_{start}$, a mode referred to as "coupled" preponderates and propagates in the direction of the longitudinal axis of the cable; the power transmitted by the cable then decreases exponentially as a function of the distance from the longitudinal axis. In this case it is only possible to guarantee the required value of minimum power at the distance specified by the user if the power transmitted by the source is greatly increased. Moreover, the connectors or fixing clips on the cable cause diffraction of the coupled mode which, even if they tend to increase the mean coupled power, gives this power a random component which prevents the minimum power required at a given distance being guaranteed with certainty.

When the operating frequency of the cable lies between $f_{start}$ and $f_{end}$, propagation in a preponderant radiated mode referred to as "principal" is observed. The transmitted power propagated radially, decreases but little with distance from the cable and stays constant, subject to the linear attenuation along the cable, whatever the point of reception along the cable. This is why a cable radiating in this frequency band is used in general to satisfy the requirements.

Finally, when the operating frequency of the cable lies above $f_{end}$, new modes of radiation appear, being called "secondary" radiating modes and interfering with the principal radiating mode. In this case, periodic variations in the power radiated by the cable are observed. The higher the frequency, the more secondary modes appear and interfere with each other. The instability of the radiated power does not allow the minimum power required at a given distance to be guaranteed with certainty, which makes it necessary to increase the radiated power of the source to satisfy the requirements of use.

In order to increase the possible uses of a radiating cable it will thus be seen that it is necessary to increase the bandwidth of the principal radiating mode as much as possible. By increasing this band of "useful" frequencies, the amount of information transmitted can be increased, which represents a non-negligible advantage at present.

An increase in the bandwidth of the principal radiating mode is not possible with periodic repetition of a single slot.

In order to increase the bandwidth of the principal mode, British patent GB 1 481 485 proposes a radiating cable in which the apertures are arranged in patterns repeated periodically along the cable. This cable is shown in elevation in FIG. 1, with its protective outer jacket cut back to allow the disposition of the slots of the pattern to be seen. In this figure, the outer conductor 2 of the radiating cable 1 comprises slots arranged in patterns M. Each pattern M has two main slots F and F' and four auxiliary slots Fa, Fb, F'a and F'b, namely an auxiliary slot to each side of each main slot. Because of the repetition of the pattern M, the secondary modes appearing at frequencies from 200 MHz to 1000 MHz (instead of 200 MHz to 400 MHz for a cable with single slots repeated periodically) are negligible and virtually zero. The patent explains how the repetition of the pattern M makes it possible to eliminate the first three secondary modes.

It is moreover emphasized in this patent that it is difficult in practice to implement patterns having more that six slots. Thus a pattern of upper size comprises six slots according to this patent, with two main slots and two auxiliary slots to each side of each main slot. Given that the pitch between each pattern, i.e. the distance separating a slot of one pattern from the corresponding slot of the next pattern, is (all other things being equal) inversely proportional to the desired value of $f_{start}$, it would be necessary either to reduce the frequency $f_{start}$ in order to increase the pitch between the patterns or to locate ten slots in an interval of length the same as that in which six slots have been placed. The distance between the slots of a pattern and between adjacent patterns is then reduced, which has the disadvantage of weakening the mechanical strength of the outer conductor.

Furthermore, the packing together of the slots and increasing their number involves the appearance of coupled modes, which leads to an increase in the linear attenuation losses and to instability in the radiated power-the coupled modes tend to interfere with the principal radiating mode and contribute to canceling out the latter.

Accordingly the structure proposed in GB 1 481 485 does not provide satisfaction, because it only allows the band of the principal mode to be increased in a restricted way.

One object of the present invention is thus to provide a radiating cable which can operate over a wide frequency band, while guaranteeing the required performance in terms of minimum radiated power at a given distance from the cable.

Another object of the present invention is to reduce, for the same principal mode, the number of slots required per pattern compared with radiating cables of the prior art.

To this end, the present invention provides a high frequency radiating line for radiating electromagnetic energy in a frequency band and comprising at least one tubular conductor surrounding a longitudinal axis and having a plurality of apertures formed into a series of identical patterns repeated periodically with a period P along said line, characterized in that, when said frequency band is of the type $[f_r, (N+1)f_r]$, where $f_r$ is a given frequency and N is a positive integer greater than 1, each of said patterns comprises N apertures numbered 0 to N−1 and satisfying the following equations:

$$z_k = \frac{P \cdot p_k}{N+2}$$

$$a_k = \frac{\sin\left(\frac{(p'-p_k)\pi}{N+2}\right)\sin\left(\frac{(p''-p_k)\pi}{N+2}\right)}{\sin\left(\frac{p'\pi}{N+2}\right)\sin\left(\frac{p''\pi}{N+2}\right)} a_o$$

where:

the index k is an integer such that $1 \leqq k \leqq N-1$ and refers to the k'th aperture of one of said patterns, $z_k$ is the distance between said k'th aperture and first aperture of said pattern, said distance being calculated between the projection of the middle of an axis of symmetry of said first aperture on to said longitudinal axis and that of the middle of a corresponding axis of symmetry of said k'th aperture on to said longitudinal axis, $a_k$ is the polarizability of said k'th aperture, $a_o$ is the polarizability of said first aperture, $$-p' = E\left(\frac{N+2}{4}\right) \text{or } p' = E\left(\frac{N+2}{4}\right) + 1$$

$$-p'' = E\left(\frac{3(N+2)}{4}\right) \text{or } p'' = E\left(\frac{3(N+2)}{4}\right) + 1$$

where E(x) designates the integer part of x, $p_k$ is an integer such that $1 \leqq p_k \leqq N+1$, said integers $p_k$ being pairwise distinct, such that $p_k < p_{k+1}$, and different from p' and p''.

The line according to the invention may be used in a band of frequencies of desired width with the periodic repetition of a pattern having an optimum number of slots. The range of use of conventional lines is thus augmented to a greater extent than in the prior art with performances in terms of minimum power required guaranteed over the range of use.

The apertures may be elliptical or rectangular for example.

When the apertures are rectangular and of length large compared with their width, the first aperture of a pattern preferably has a length making an angle with the longitudinal axis having an absolute value from 5° to 90°; this length is called L. The angle made by an aperture with the longitudinal axis is the angle measured from the longitudinal axis made by the projection of the aperture in a direction orthogonal to the longitudinal axis on to a plane containing the longitudinal axis and orthogonal to the direction of projection.

According to a first embodiment, N is equal to 3 and the apertures are disposed in the following manner:

the second aperture is at a distance of P/5 from the first aperture, has the same length as the first aperture and makes the same angle with the longitudinal axis as the first aperture, the third aperture is at a distance of 3P/5 from the first aperture, has a length substantially equal to 3L/4 and makes an angle with the longitudinal axis opposite to that of the first aperture.

According to a second embodiment, N is equal to 4 and the apertures are disposed in the following manner:

the second aperture is at a distance of P/6 from the first aperture, has the same length as the first aperture and makes the same angle with the longitudinal axis as the first aperture, the third aperture is at a distance of P/2 from the first aperture, has the same length as the first aperture and makes and angle with the longitudinal axis opposite to that of the first aperture, the fourth aperture is at a distance of 2P/3 from the first aperture, has the same length as the first aperture and makes an angle with the longitudinal axis opposite to that of the first aperture.

According to a third embodiment, N is equal to 5 and the apertures are disposed in the following manner:

the second aperture is at a distance of P/7 from the first aperture, has a length substantially equal to 5L/6 and makes the same angle with the longitudinal axis as the first aperture, the third aperture is at a distance of 3P/7 from the first aperture, has a length substantially equal to 7L/9 and makes an angle with the longitudinal axis opposite to that of the first aperture, the fourth aperture is at a distance of 4P/7 from the first aperture, has a length substantially equal to 7L/9 and makes an angle with the longitudinal axis opposite to that of the first aperture, the fifth aperture is at a distance of 6P/7 from the first aperture, has a length equal to that of the first aperture and makes the same angle with the longitudinal axis as the first aperture.

According to a first application of the invention, the tubular conductor is cylindrical and contains a center conductor surrounded by a protective sheath of dielectric material in contact both with the center conductor and with the tubular conductor, and a protective outer jacket, such as to give the line the structure of a radiating cable.

According to a second application of the invention, the tubular conductor is empty, so as to give the line the structure of a radiating waveguide.

Other characteristics and advantages of the present invention will appear from the following description of a radiating cable in accordance with the invention, given by way of non-limiting example.

Figure 1:
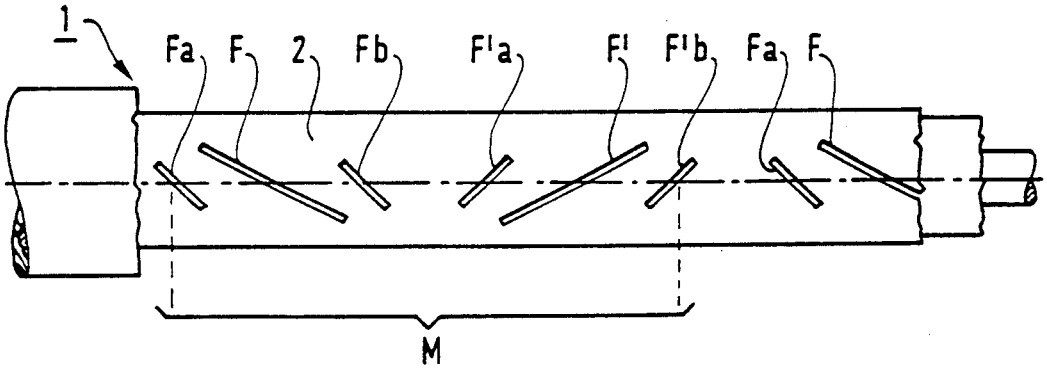
FIG.1 PRIOR ART
FIG. 1 shows the radiating cable described in GB 1 481 485, in elevation.
Figure 2:
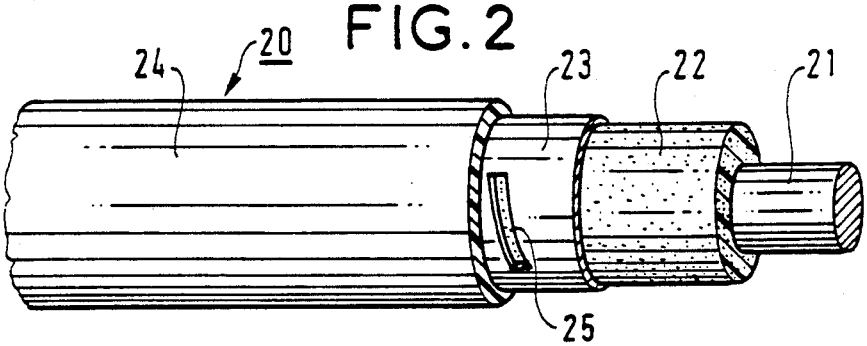
FIG. 2 shows a radiating cable of the invention in broken away perspective.
Figure 3:
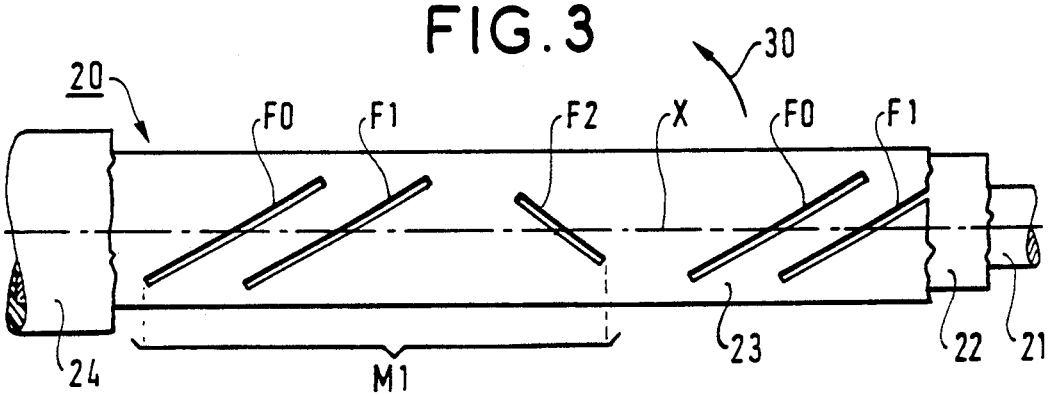
Figure 4:
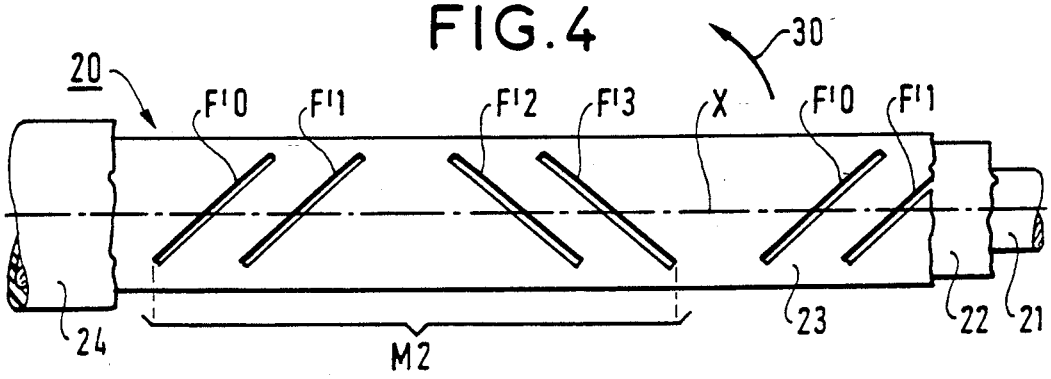
Figure 5:
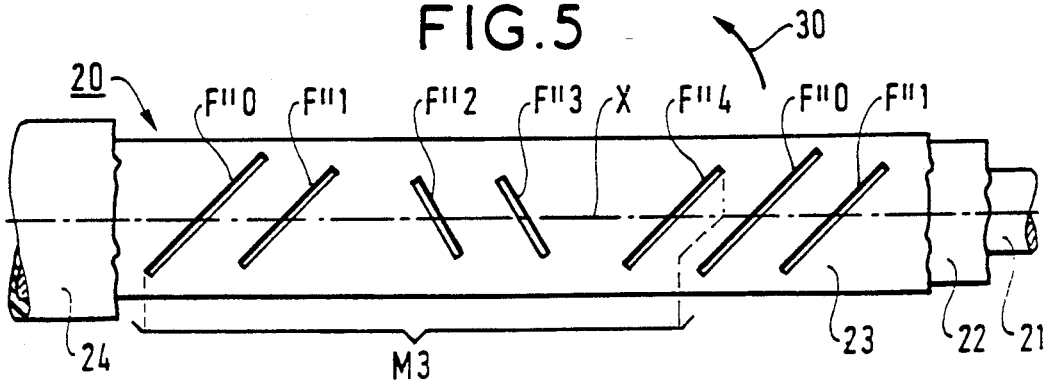
Figure 6:
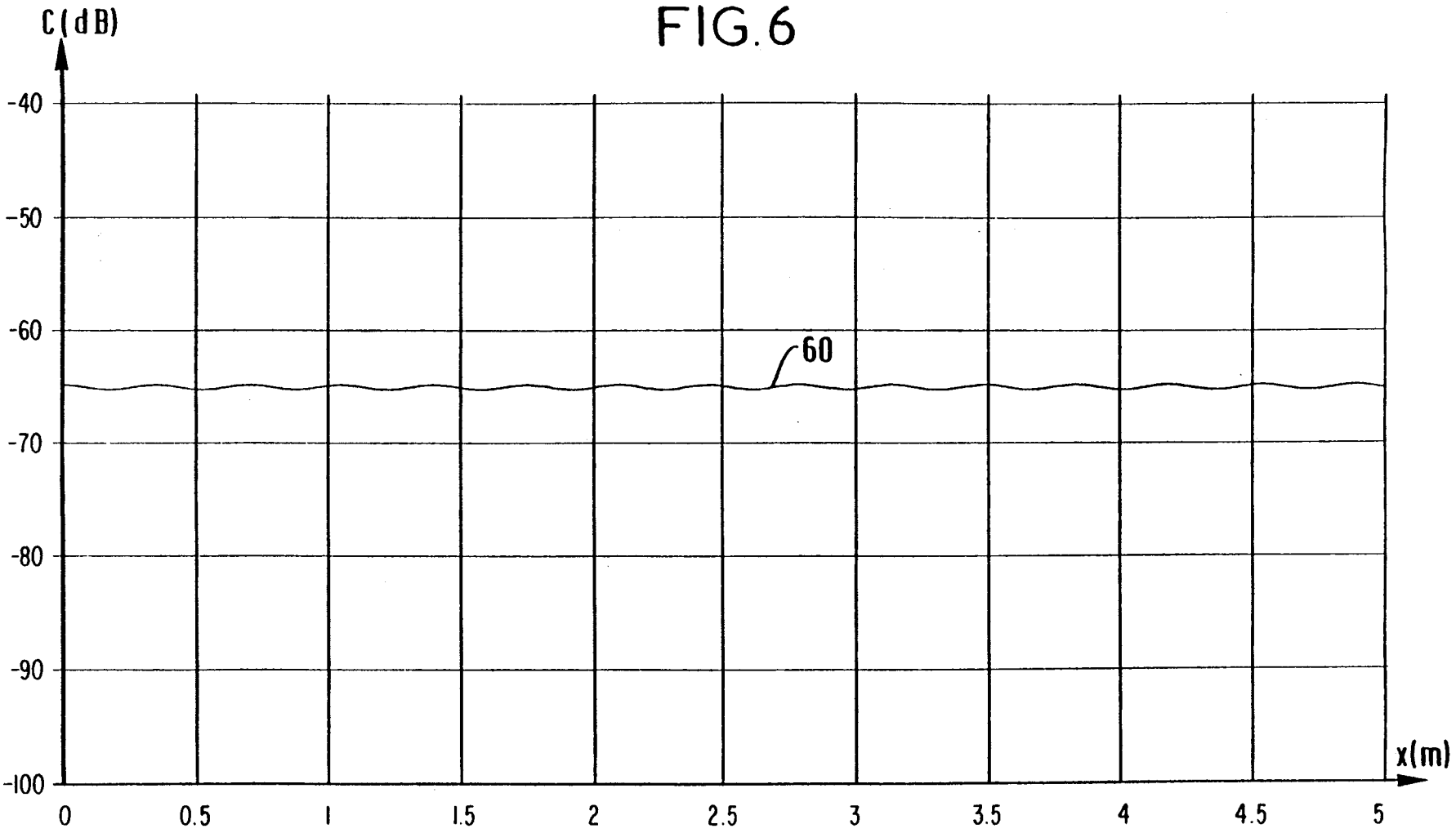
Figure 7:
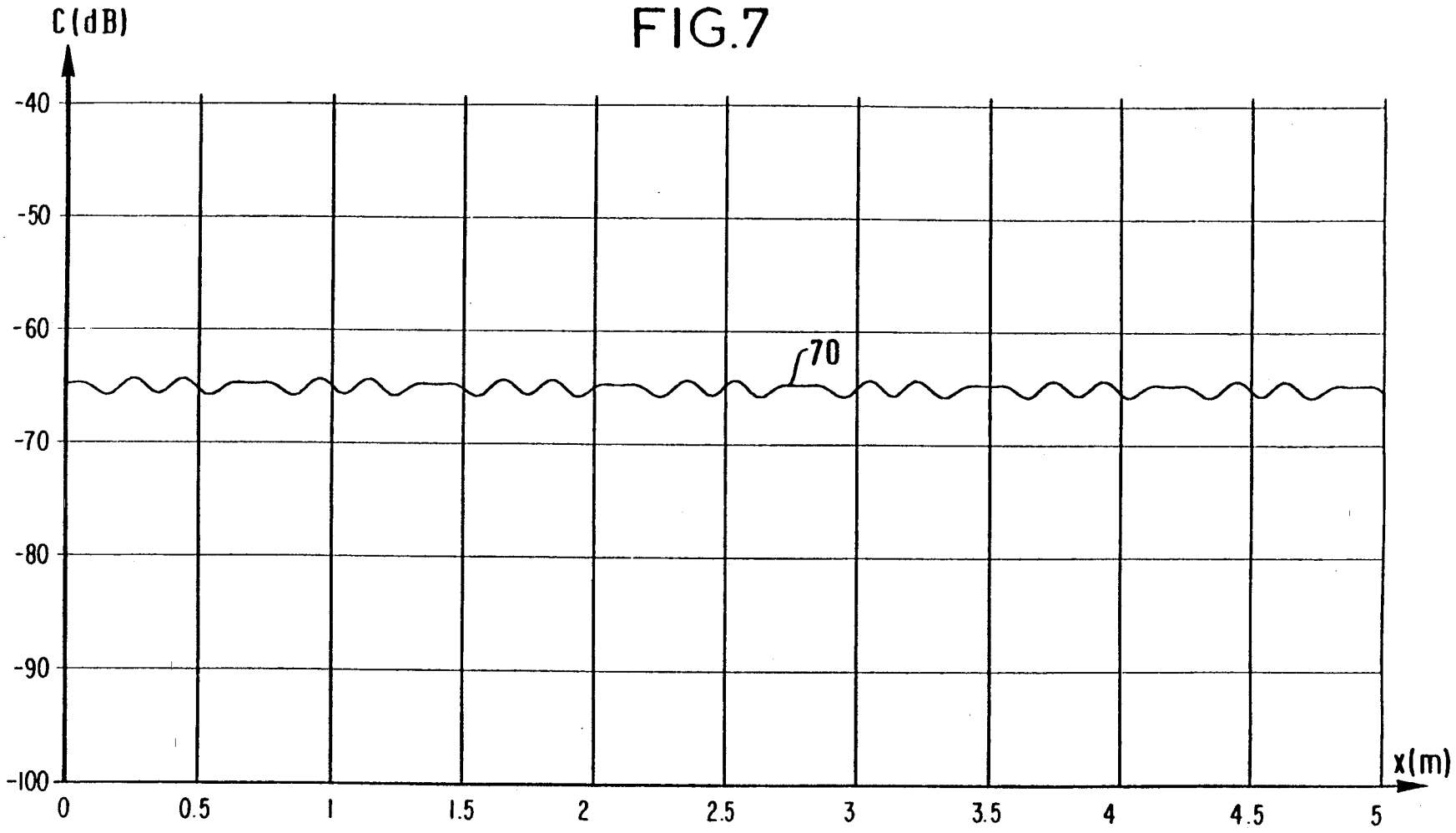
Figure 8:
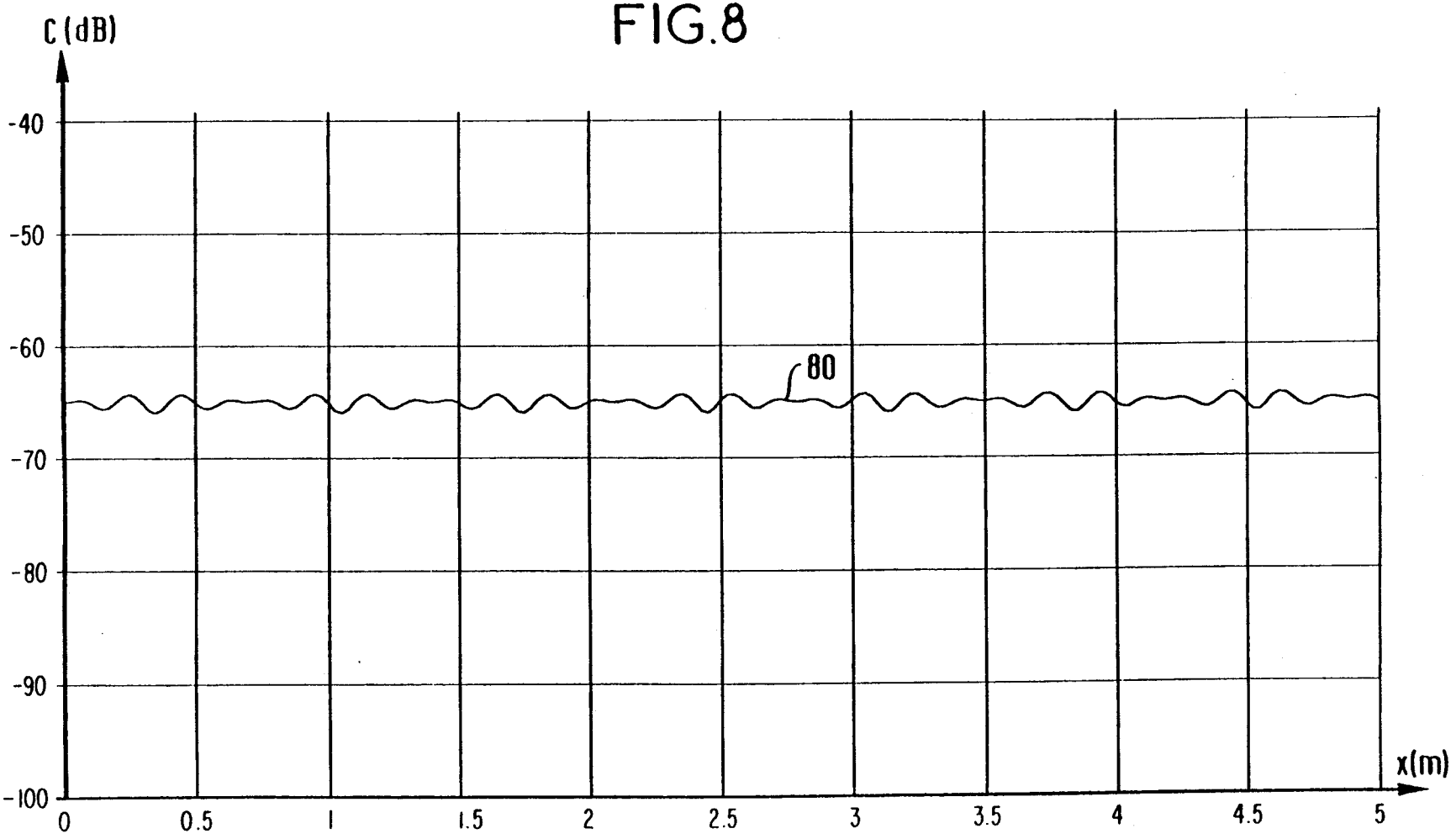
Figure 9:
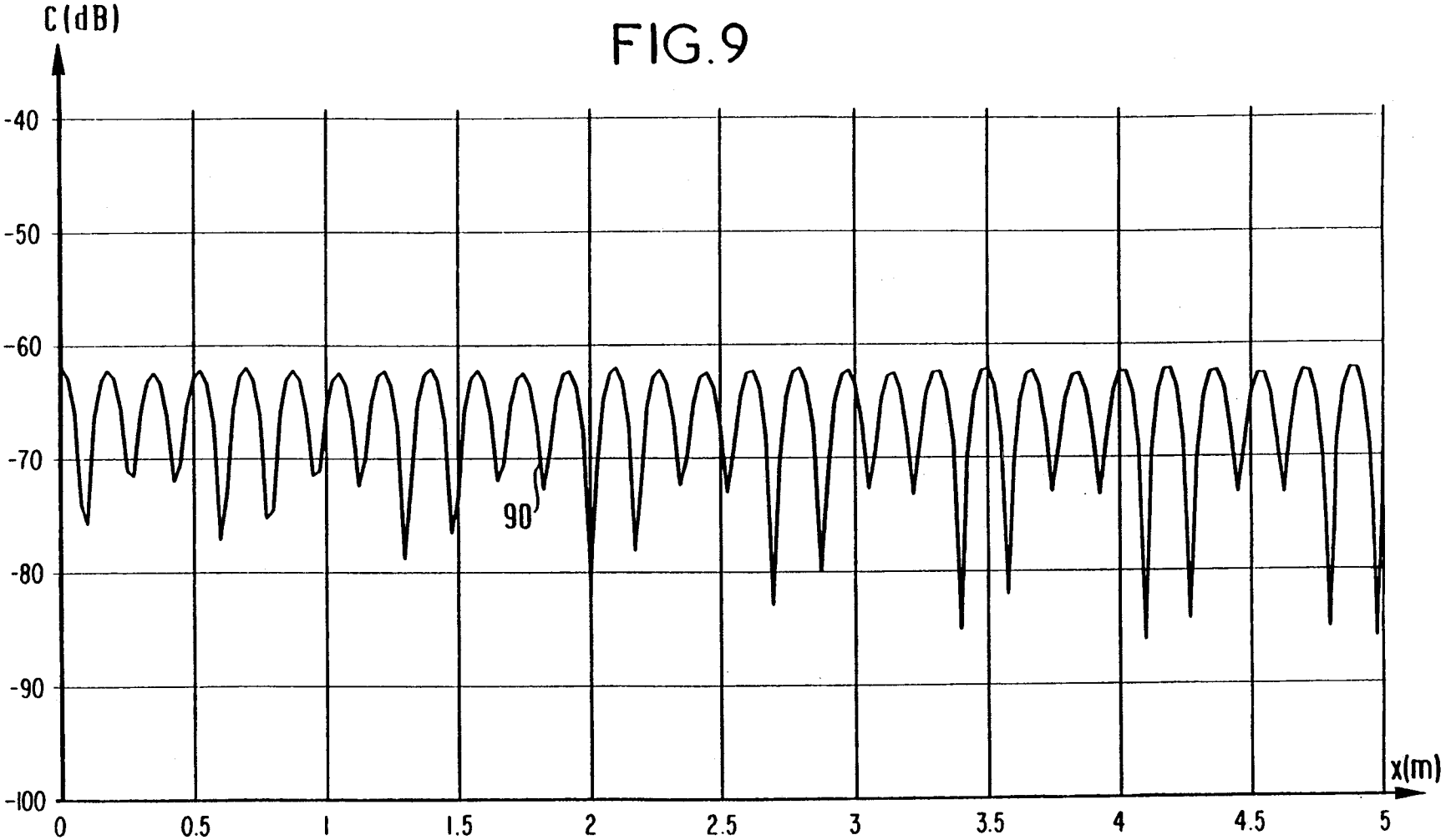
Figure 10:
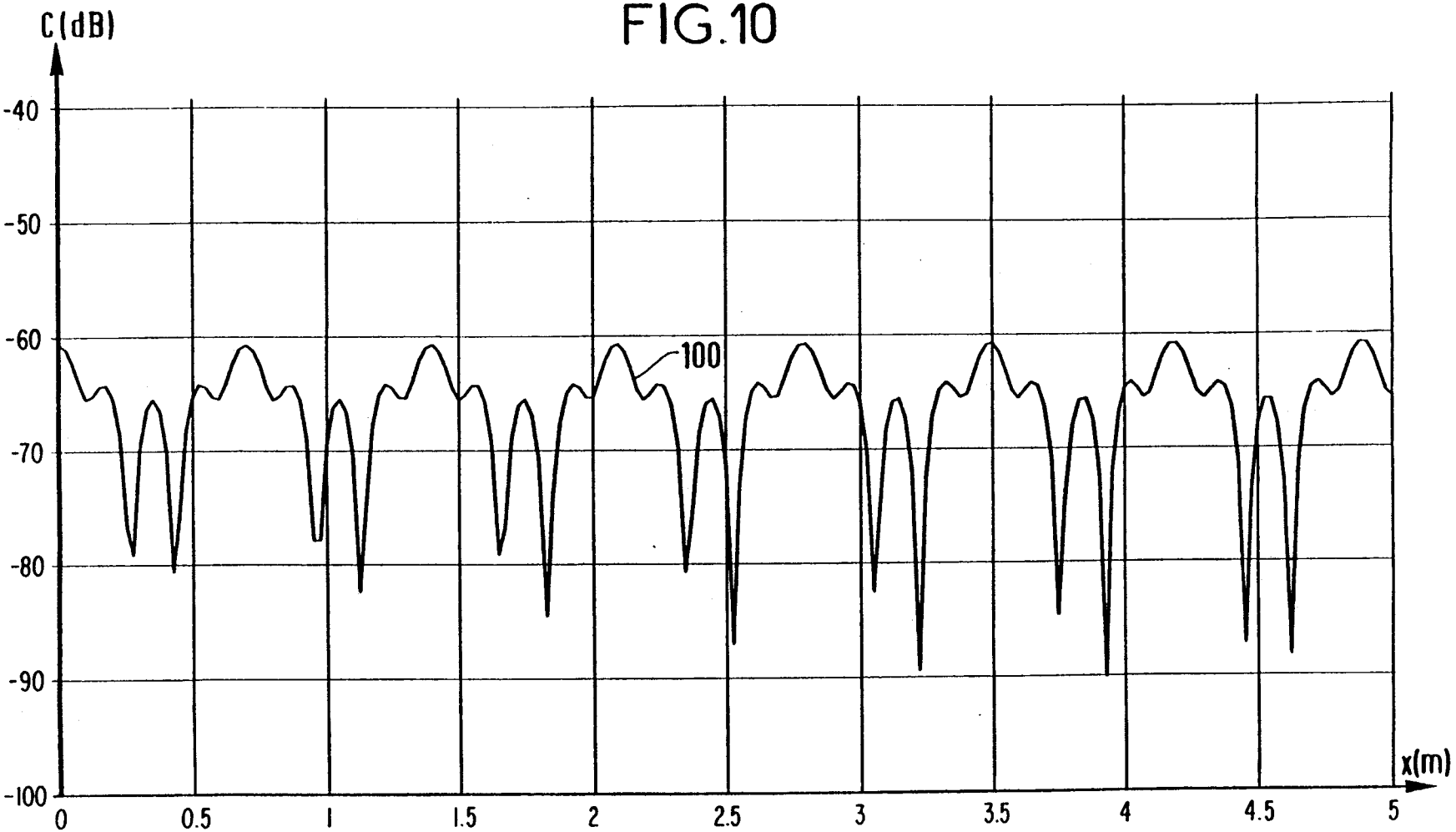

FIG. 3 is an elevation of a first variant of the radiating cable of FIG. 2, with its outer jacket cut back to better show the disposition of the slots, FIG. 4 is an elevation of a second variant of the radiating cable of FIG. 2, with its outer jacket cut back to better show the disposition of the slots, FIG. 5 is an elevation of a third variant of the radiating cable of FIG. 2, with its outer jacket cut back to better show the disposition of the slots, FIG. 6 is a graph denoting the coupling of a cable such as that of FIG. 3, FIG. 7 is a graph denoting the coupling of a cable such as that of FIG. 4, FIG. 8 is a graph denoting the coupling of a cable of the invention with six slots, FIG. 9 is a graph denoting the coupling of a prior art cable such as that of FIG. 1, FIG. 10 is a graph denoting the coupling of a prior art cable with simple repetition of slots.

FIG. 1 has been described already in the presentation of the state of the art.

Common parts in FIGS. 2 to 5 have the same reference numerals.

FIG. 2 shows a radiating cable 20 of the invention in broken away perspective. The cable 20 comprises, coaxially from the interior of to the exterior:

- a conductive core 21 of copper or aluminum,
- a sheath 22 of dielectric material, such as polyethylene for example,
- an outer conductor 23 having apertures or slots 25 (of which one only is visible in FIG. 2), formed in patterns repeated periodically all along the cable 20,
- an outer protective jacket 24 of insulating material.

The method whereby the disposition and number of slots in the patterns of a cable of the invention are determined will now be explained.

In the first place, the lower frequency of the principal radiating band, denoted $f_r$, is generally determined by the specifications of the user of the cable. It establishes in known manner the repetition pitch P of the patterns (i.e. the distance between a given slot of one pattern and the corresponding slot of the immediately adjacent pattern) according to the following formula:

$$f_r = \frac{c}{(1+\sqrt{\epsilon})P}$$

where c is the speed of light in vacuum and $\epsilon$ is the dielectric permittivity of the sheath 22 of the cable.

The object of the invention is to determine the number $N_f$ and the disposition of the slots in a pattern when the band of the principal mode is of the type $[f_r,(N+1)f_r]$, where N is an integer greater than 1. (If N is equal to 1, the problem is conventional and results in a pattern of a single slot). As to the lengths and inclination of the different slots of a pattern, they are selected as a function of the length and inclination of the first slot by means of models well known to the person skilled in the art and which will be reverted to in a little more detail below.

By means of a near-field calculation, the expression is determined for the near field radiated by a cable whose conductor has a series of identical patterns, each comprising $N_f$ slots and repeating with a periodicity of P. It is then shown that it is sufficient if $N_f$ is made equal to N, i.e. there are N slots in the pattern to cancel out the N−1 secondary modes appearing in the band $[f_r, (N+1)f_r]$; (it should be noted that a secondary mode will become preponderant at each frequency of the form $mf_r$, where m is a positive integer). This leads to the following system of equations:

$$A_1e^{2j\psi_1} + A_2e^{2j\psi_2} + \ldots + A_{N-1}e^{2j\psi_{N-1}} = -1$$
$$A_1e^{3j\psi_1} + A_2e^{3j\psi_2} + \ldots + A_{N-1}e^{3j\psi_{N-1}} = -1$$
$$\vdots$$
$$A_1e^{(N-1)j\psi_1} + A_2e^{(N-1)j\psi_2} + \ldots + A_{N-1}e^{(N-1)j\psi_{N-1}} = -1$$

where for each value of k from 1 to N−1 inclusive:

- $A_k = a_k/a_o$, $a_k$ being the polarizability of the k'th slot and the index 0 representing the first of the slots of the pattern, taken as a reference. The polarizability of a slot may be interpreted as the radiating capacity of this slot, considered as a source. Reference is made for more details on polarizability to pages 56 to 59 of the work entitled "Leaky feeders and subsurface radio communications" by P. Delogne, appearing in the series of Peter Peregrinus Ltd.
- $\psi_k = 2\pi(z_k - z_o)/P$, $z_k$ being the distance between the orthogonal projection on to the longitudinal axis of the cable of the middle of the k'th slot (or of any other point pertaining to an axis of symmetry of the latter) and the orthogonal projection on to the longitudinal axis of the cable of the middle of the reference slot (or of any other point pertaining to an axis of symmetry of the latter), where the abscissa $z_o$ is taken equal to 0; (the abscissae are calculated along the longitudinal axis X of the cable 20).

The solutions to this system, such that k is from 1 to N−1 inclusive, are:

$$a_k = \frac{\sin\left(\frac{p'-p_k)\pi}{N+2}\right)\sin\left(\frac{(p''-p_k)\pi}{N+2}\right)}{\sin\left(\frac{p'\pi}{N+2}\right)\sin\left(\frac{p''\pi}{N+2}\right)} a_o \quad (1)$$

$$\psi_k = \frac{2p_k\pi}{(N+2)}, \text{ or } z_k = \frac{P \cdot p_k}{(N+2)} \quad (2)$$

where:

- $p_k$ is a positive integer between 1 and to N+1 inclusive, the integers $p_k$ being pairwise distinct, such that $p_k < p_{k+1}$,
- p' and p'' are two integers between 1 and N+1 inclusive; how these are determined will be explained later.

Once the length and inclination of the first slot are selected in a manner compatible with the diameter of the cable and such that the angle (as an absolute value) between the longitudinal axis of the cable and the first slot is from 5° to 90°, the lengths, positions and inclinations of the other slots of the pattern are determined by means of the preceding relations. Firstly it is noted that in all that follows, the inclination of a slot means the angle, measured from the longitudinal axis, made by the projection in a direction orthogonal to the longitudinal axis of the aperture on to a plane containing the longitudinal axis and orthogonal to the direction of projection.

The inclination of the first slot is preferably chosen in the range specified above, because it is well known that the contribution to radiation of a slot parallel to the longitudinal axis of the cable is equal to zero. Accordingly it is preferable to select an inclination relative remote from 0°. On the other hand it is equally known to the person skilled in the art that the contribution of a slot to the radiation increases with its length. Accordingly it is preferable for the inclination of the slots not to exceed a predetermined value, which depends on the outside diameter of the cable, so as to have a large choice of slot lengths, without being limited by impossibility of technological realization imposed by the outer diameter of the cable, which is fixed. In the present case, for a cable with an outer diameter of 25 mm and slots 150 mm long, the upper limit on the preferred range of inclination is 30°; the inclination is preferably selected from 15° to 25°.

Use of a conventional model allows the inclination and length of the k'th slot to be derived as a function of that of the first slot, from the value of the polarizability of the k'th slot. According to this model the sign of the polarizability of the k'th slot gives its inclination as a function of that of the first slot and the ratio between $a_k$ and $a_o$ allows the length of the k'th slot to be determined as a function of the length of the first slot.

Thus, if $a_k$ and $a_o$ have the same sign, the same inclination is selected for the reference slot and the k'th slot. If $a_k$ and $a_o$ have opposite signs, the k'th slot will make and angle with the X axis opposite to that of the reference slot.

On the other hand, if $a_k$ is greater than $a_o$, the k'th slot will have a length greater than that of the reference slot. Likewise, if $a_k$ is less than $a_o$, the k'th slot will have a length less than that of the reference slot.

The position of the k'th slot relative to the reference slot is obtained by selecting an integer $p_k$ in accordance with the conditions referred to above. Numerous choices are possible since the set of integers $p_k$ contains N+1 members, whereas there are only N−1 positions to determine once that of the first slot is taken as the reference. Any of the possible choices are suitable to achieve the desired object. However, certain of these choices allow a maximum radiated power in the principal mode to be obtained. To locate these, combinations of integers $p_k$ are sought which maximize the modulus of the function:

$$\frac{1 + A_1 e^{j\psi 1} + A_2 e^{j\psi 2} + \ldots + A_{N-1} e^{j\psi N-1}}{1 + |A_1| + |A_2| + \ldots + |A_{N-1}|}.$$

The choice of integers $p_k$ giving the maximum radiated power of the principal mode for the pattern is obtained by means of an optimizing numerical calculation for example. In practice, this comes down to eliminating the integers p' and p'' from the set of integers $p_k$ where:

$$-p' = E\left(\frac{N+2}{4}\right) \text{or } p' = E\left(\frac{N+2}{4}\right) + 1$$

$$-p'' = E\left(\frac{3(N+2)}{4}\right) \text{or } p'' = E\left(\frac{3(N+2)}{4}\right) + 1$$

where E(x) is the integer part of x.

Various radiating cables implemented in accordance with the invention will now be described, as examples and with reference to FIGS. 3 to 5.

In all the examples, the frequency $f_r$ is taken to be 200 MHz and the permittivity of the dielectric is $\epsilon = 1.3$. P is thus around 700 mm.

EXAMPLE 1

FIG. 3 shows a radiating cable 20 whose outer conductor has a pattern of slots M1. The cable is required to operate over the range [200 MHz, 800 MHz]. N is thus equal to 3 and the pattern M1 comprises three slots denoted F0, F1 and F2 respectively. The slot F0 is taken as the reference for the abscissae.

In accordance with equations (1) and (2) above:

$a_1 = a_o$, $z_1 = P/5 = 140$ mm $a_2 = -0.618a_o$, $z_2 = 3P/5 = 420$ mm.

The pattern M1 shown in FIG. 3 is obtained, with a slot F0 140 mm long and inclined at an angle of 18° to the X axis, (the angles being measured positively in the trigonometrical sense indicated by the arrow 30, from the X axis). The slot F1 has a length and an inclination identical to that of F0. The slot F2 has a length of 115 mm and is inclined at −18° relative to the X axis.

EXAMPLE 2

FIG. 4 shows a radiating cable 20 whose outer conductor has a pattern of slots M2. The cable is required to operate over the range [200 MHz, 1000 MHz]. N is thus equal to 4 and the pattern M2 comprises four slots denoted F'0, F'1, F'2 and F'3 respectively. The slot F'0 is taken as the reference for the abscissae.

In accordance with equations (1) and (2) above:

$a'_1 = a'_o$, $z'_1 = P/6 = 116.7$ mm $a'_2 = -a'_o$, $z'_2 = P/2 = 350$ mm $a'_3 = -a'_o$, $z'_3 = 2P/3 = 466.7$ mm.

The pattern M2 shown in FIG. 4 is obtained, with a slot F'0 100 mm long and inclined at an angle of 18° to the X axis. The slot F'1 has a length and an inclination identical to that of F'0. The slots F'2 and F'3 each have a length equal to that of F'0 and are inclined at −18° relative to the X axis.

Whereas GB 1 481 485 proposes to use a pattern of six slots to allow operation of the radiating cable over the frequency band [200 MHz, 1000 MHz], the patterns of a cable of the invention allowing operation over the same frequency band only comprise four slots. This makes it possible to reduce the coupling and the linear attenuation losses and to ensure improved mechanical strength of the cable, still guaranteeing the required minimum power. Furthermore, the four slots of the pattern M2 can be identical, which simplifies the implementation of the corresponding cable 20.

EXAMPLE 3

FIG. 5 shows a radiating cable 20 whose outer conductor has a pattern of slots M3. The cable is required to operate over the range [200 MHz, 1200 MHz]. N is thus equal to 5 and the pattern M3 comprises five slots denoted F''0, F''1, F''2, F''3 and F''4 respectively. The slot F''0 is taken as the reference for the abscissae.

In accordance with equations (1) and (2) above:

$a''_1 = 0.692a''_o$, $z''_1 = P/7 = 100$ mm $a''_2 = -0.555a''_o$, $z''_2 = 3P/7 = 300$ mm $a''_3 = -0.555a''_o$, $z''_3 = 4P/7 = 400$ mm $a''_4 = 0.692a''_o$, $z''_4 = 6P/7 = 600$ mm.

The pattern M3 shown in FIG. 5 is obtained, with a slot F''0 90 mm long and inclined at an angle of 18° to the X axis. The slot F"1 has a length of 77.6 mm and an inclination identical to that of F"0. The slots F"2 and F"3 each have a length of 70.8 mm and are inclined at −18° relative to the X axis. The slot F"4 has a length identical to that of F"1 and the same inclination as F"0.

According to the teaching of GB 1 481 485, it is only possible to obtain frequency bands of the type [$f_r$, (2 m+1)$f_r$], where m is a positive integer. Accordingly, to implement a radiating cable operating over the frequency band [200 MHz, 1200 MHz] it would be necessary to provide patterns of slots allowing operation over the band [200 MHz, 1400 MHz], namely a pattern of ten slots. On the one hand a pattern of ten slots according to this patent has the disadvantages referred to in the introduction and, on the other hand, the need to design the cable to operate over a frequency band greater that the frequency band which is used involves additional cost, which is undesirable. Thanks to the invention, only five slots per pattern are necessary and the frequency band for which the cable is designed is equal to the used band.

The invention thus allows radiating cables to be implemented with a principal radiating mode band greater than that of the prior art cables, because of the periodic repetition of patterns comprising an optimum number of slots.

The problems posed by the prior art solutions are thus resolved by the invention.

Some results obtained with cables of the invention will now be given, with reference to FIGS. 6 to 10, as well as those obtained with two prior art cables.

In FIG. 6 there is shown the coupling C in dB as a function of the distance x between the end of the cable nearest to the transmitting source and the point of reception in question along the cable which is being measured. It is recalled that the coupling at a given point of reception is proportional to the logarithm of the ratio between the power radiated by this point of reception and the power emitted by the source, which is constant. Thus, if the coupling is practically uniform, the radiated power is also.

The graph 60 shown in FIG. 6 corresponds to an operating frequency of 700 MHz of the cable according to example 1 above, shown in FIG. 3. It is noted that the coupling is virtually uniform regardless of the point of reception along the cable.

The graph 70 shown in FIG. 7 corresponds to an operating frequency of 900 MHz of the cable according to example 2 above, shown in FIG. 4. It is again noted that the coupling is virtually uniform regardless of the point of reception along the cable. Moreover, the cable of the invention with four slots allows such a result to be obtained up to at least 900 MHz and in practice up to 1000 MHz, whereas patterns of six slots are needed according to the prior art to obtain such an upper limit for the principal radiating mode.

The graph 80 shown in FIG. 8 corresponds to an operating frequency of 1100 MHz for a cable of the invention with six slots. This graph can be compared with the graph 90 of FIG. 9, corresponding to the cable of FIG. 1 at the same operating frequency (1100 MHz), that is to say according to the prior art described in GB 1 481 485. It is noted that the coupling along the cable of the invention with six slots is practically uniform, whereas that of a cable such as that in FIG. 1 exhibits periodic variations which prevent the required performance in terms of minimum radiated power over the frequency band running up to at least 1100 MHz being obtained. With the same number of slots, a cable in accordance with the invention allows practically uniform coupling to be obtained up to frequencies in the order of 1400 MHz.

Finally, the graph 100 shown in FIG. 10 is given for information. It corresponds to an operating frequency of 1100 MHz for a cable with repeated simple slots. It is noted that the coupling varies periodically as a function of the distance.

Obviously the invention is not limited to the embodiment which has been described.

In particular, the model used for the choice of lengths and inclinations of the various slots of a pattern is given by way of example and any other model commonly used by the person skilled in the art in this field could be chosen. In particular, models can be used in which the lengths and inclinations vary from one slot to another, or models in which the inclinations vary from one slot to another.

Furthermore, the invention is equally applicable to radiating waveguides formed by a tubular conductor of any cross-section, possibly surrounded by a protective outer jacket.

The apertures formed in the outer conductor may be rectangular or elliptical. They preferably have a length different from the width, which gives them increased efficiency.

Finally, the angle between the slots and the longitudinal axis in each pattern may be anything so long as the contribution of each radiating slot is not zero and the total radiated power obtained is compatible with the specifications given by the user.

I claim:

1. A high frequency radiating line for radiating electromagnetic energy in a frequency band and comprising at least one tubular conductor (23) surrounding a longitudinal axis (X) and having a plurality of apertures formed into a series of identical patterns (M1) repeated periodically with a period P along said line, characterized in that, for a frequency band of the type, where $f_r$ is a given frequency and N is a positive integer greater than 1, each of said patterns (M1) comprises N apertures numbered 0 to N−1 and satisfying the following equations:

$$z_k = \frac{P \cdot p_k}{N+2}$$

$$a_k = \frac{\sin\left(\frac{(p'-p_k)\pi}{N+2}\right)\sin\left(\frac{(p''-p_k)\pi}{N+2}\right)}{\sin\left(\frac{p'\pi}{N+2}\right)\sin\left(\frac{p''\pi}{N+2}\right)} a_o$$

where:

the index k is an integer such that $1 \leqq k \leqq N-1$ and refers to the k'th aperture of one of said patterns (M1), $z_k$ is the distance between said k'th aperture and first aperture (F0) of said pattern, said distance being calculated between the projection of a point of an axis of symmetry of said first aperture (F0) on to said longitudinal axis (X) and that of a point of a corresponding axis of symmetry of said k'th aperture on to said longitudinal axis (X), $a_k$ is the polarizability of said k'th aperture, $a_o$ is the polarizability of said first aperture, $$-p' = E\left(\frac{N+2}{4}\right) \text{or } p' = E\left(\frac{N+2}{4}\right) + 1$$

$$-p'' = E\left(\frac{3(N+2)}{4}\right) \text{or } p'' = E\left(\frac{3(N+2)}{4}\right) + 1$$

where E(x) designates the integer part of x, $p_k$ is an integer such that $1 \leqq p_k \leqq N+1$, said integers $p_k$ being pairwise distinct, such that $p_k < p_{k+1}$, and different from p' and p''.

2. A line according to claim 1, characterized in that said tubular conductor (23) is cylindrical and contains a center conductor (21) surrounded by a protective sheath of dielectric material (22) in contact both with said center conductor (21) and with said tubular conductor (23), and a protective outer jacket (24), such as to give said line (20) the structure of a radiating cable.

3. A line according to claim 1, characterized in that said tubular conductor is empty, so as to give said line the structure of a radiating waveguide.

4. A line according to claim 1, characterized in that said apertures are elliptical.

5. A line according to claim 1, characterized in that said apertures are rectangular.

6. A line according to claim 5, characterized in that said apertures have a length large compared with their width.

7. A line according to claim 6, characterized in that the first said aperture of a pattern has a length denoted L and makes an angle having an absolute value from 5° to 90° with said longitudinal axis, where the angle made by an aperture with said longitudinal axis is the angle measured from said longitudinal axis made by the projection in a direction orthogonal to said longitudinal axis of said aperture on to a plane containing said longitudinal axis and orthogonal to said direction of projection.

8. A line according to claim 7, characterized in that N is equal to 3 and in that said apertures are disposed in the following manner:

the second said aperture (F1) is at a distance of P/5 from said first aperture (F0), has the same length as said first aperture (F0) and makes the same angle with said longitudinal axis (X) as said first aperture (F0), the third said aperture (F2) is at a distance of 3P/5 from said first aperture (F0), has a length substantially equal to 3L/4 and makes an angle with said longitudinal axis opposite to that of said first aperture.

9. A line according to claim 7, characterized in that N is equal to 4 and in that said apertures are disposed in the following manner:

the second said aperture (F'1) is at a distance of P/6 from said first aperture (F'0), has the same length as said first aperture and makes the same angle with said longitudinal axis as said first aperture, the third said aperture (F'2) is at a distance of P/2 from said first aperture, has the same length as said first aperture and makes an angle with said longitudinal axis opposite to that of said first aperture, the fourth said aperture (F'3) is at a distance of 2P/3 from said first aperture, has the same length as said first aperture and makes an angle with said longitudinal axis opposite to that of said first aperture.

10. A line according to claim 4, characterized in that N is equal to 5 and in that said apertures are disposed in the following manner:

the second said aperture (F''1) is at a distance of P/7 from said first aperture (F''0), has a length substantially equal to 5L/6 and makes the same angle with said longitudinal axis as said first aperture, the third said aperture (F''2) is at a distance of 3P/7 from said first aperture, has a length substantially equal to 7L/9 and makes an angle with said longitudinal axis opposite to that of said first aperture, the fourth said aperture (F''3) is at a distance of 4P/7 from said first aperture, has a length substantially equal to 7L/9 and makes an angle with said longitudinal axis opposite to that of said first aperture, the fifth said aperture (F''5) is at a distance of 6P/7 from said first aperture (F''0), has a length equal to that of said first aperture and makes the same angle with said longitudinal axis as said first aperture.

* * * * *